US007306456B2

(12) United States Patent
Li

(10) Patent No.: US 7,306,456 B2
(45) Date of Patent: Dec. 11, 2007

(54) AUTOCONTROL BURNER AND A COMBUSTION CONTROL METHOD

(76) Inventor: Yanxin Li, Room 2208, Tower A, Wang Jing Jia Run Garden, West Ba Jian Fang, Chaoyang District, Beijing (CN) 100102

( * ) Notice: Subject to any disclaimer, the term of this patent is extended or adjusted under 35 U.S.C. 154(b) by 0 days.

(21) Appl. No.: 10/538,982

(22) PCT Filed: Dec. 25, 2002

(86) PCT No.: PCT/CN02/00915

§ 371 (c)(1),
(2), (4) Date: Jun. 15, 2005

(87) PCT Pub. No.: WO2004/059211

PCT Pub. Date: Jul. 15, 2004

(65) Prior Publication Data

US 2006/0068347 A1 Mar. 30, 2006

(51) Int. Cl.
*F23N 1/02* (2006.01)
*F23N 5/00* (2006.01)

(52) U.S. Cl. ..... 431/89; 431/75; 431/12

(58) Field of Classification Search ..... 431/89, 431/75, 78, 79, 80, 12
See application file for complete search history.

(56) References Cited

U.S. PATENT DOCUMENTS 4,334,854 A * 6/1982 Graat et al. ..... 431/8
5,049,063 A * 9/1991 Kishida et al. ..... 431/78
6,295,937 B1 * 10/2001 Nakanishi et al. ..... 110/190

FOREIGN PATENT DOCUMENTS

| | | |
|---|---|---|
| CN | 2135723 Y | 6/1993 |
| CN | 2511876 Y | 9/2002 |
| JP | 60194215 | 10/1985 |

OTHER PUBLICATIONS

Form PCT/ISA/210 for PCT/CN02/00915.

* cited by examiner

*Primary Examiner*—Alfred Basichas
(74) *Attorney, Agent, or Firm*—Alix, Yale & Ristas, LLP

(57) ABSTRACT

A combustion control method for a burner comprises: the fuel supplying means outputs a given amount of fuel oil to the fuel oil atomizing means; the fuel atomizing means sprays fuel atomized gas; said gas is ignited by the igniter; the amount of air is sent to facilitate burning by the air blowing means; the outputting flow rate of fuel oil and the flow rate of air are adjusted automatically, simultaneously and proportionally by controlling the rotating speed of the electric motors of the fuel supplying means and the air blowing means. An autocontrol burner comprises a main body, an oil pump (2), a blower fan (1), a spray gun (9) and an ignition gun (10), and further comprises a programmable control unit (18), motor speed controller (16, 17) and a signal acquisition assembly. The output port of the signal acquisition assembly is connected with the input port of the programmable control unit (18). The oil pump (2) and the blower fan (1) are connected with the programmable control unit (18) by the motor speed controller (16, 17).

11 Claims, 8 Drawing Sheets

AUTOCONTROL BURNER AND A COMBUSTION CONTROL METHOD

This application is the U.S. National Stage of International Application No. PCT/CN2002/000915, filed Dec. 25, 2002, the contents of which are incorporated herein by reference in their entirety.

FIELD OF THE INVENTION

The present invention relates to adjustment and control of the combustion, particularly to a combustion control method and an autocontrol burner that can adjust automatically the air/oil ratio for the combustion of the fuel oil.

BACKGROUND OF THE INVENTION

The present conventional auto burners are all mechanical actuated, i.e. the flame size is adjusted by changing the rotating direction of the motor of the electric actuator, and by means of a connecting rod that actuates a damper and a fuel oil regulating valve. For example, an autocontrol burner is produced by an German company named Benninghoven (see FIG. 1), which can adjust the flame by changing the rotating direction of the motor of the electric actuator 5 using a rotating direction control circuit 6, and by means of the connecting rod that actuates the damper 4 and the fuel oil regulating valve 3. This kind of conventional auto burner has some defects such as high energy consumption (unable to consider both of the air/oil ratios of light oil and heavy oil at the same time, meanwhile difficult to adjust the air/oil ratio and low precision), low efficiency (the motors of the required blower fan and the oil pump are not only large in power, but also always run at the maximum number of revolutions regardless of the flame size), and complicated mechanical structure, short lifetime, great noise and poor economy environmental index etc.

SUMMARY OF THE INVENTION

An object of the invention is to provide a combustion control method and an autocontrol burner that can adjust automatically the flow rate of outputting flow rate of the fuel oil by the fuel supplying means and the flow rate of air blown by the air blowing means depending on predetermined air/oil ratio simultaneously and proportionally, without using the damper and the fuel oil regulating valve, so that the objects, i.e., low energy consumption, high efficiency, simple mechanical structure, long lifetime, low noise and high economy environmental index, are attained.

For achieve these purposes, the present invention provides a combustion control method for a burner, including the steps of:

A given amount of fuel oil is supplied to a fuel oil atomizing means by a fuel supplying means;

the atomized fuel oil gas is spouted by the fuel oil atomizing means;

The atomized fuel oil gas is ignited by an igniter;

Combustion is facilitated by the air blown by an air blowing means;

Wherein the outputting flow rate of fuel oil and flow rate of air are adjusted automatically, simultaneously and proportionally by controlling the rotating speed of the motors of the fuel supplying means and the air blowing means.

The combustion control method for burner is wherein said simultaneous and proportional control method is achieved by calculating the flow rate of air and the flow rate of fuel oil based on the predefined air/oil ratio, said air/oil ratio is calculated based on a specific relational curve which is a relational curve between required flow rate of fuel oil output by the fuel supplying means and flow rate of air blown by the air blowing means in order to achieve optimal combustion effect.

The combustion control method for burner is wherein said autocontrol method is implemented by an automatic control program which adjusts the outputting flow rate of fuel oil and flow rate of air in accordance with the air/oil ratio, the automatic control program including the following steps:

the step of determining the atomized gas pressure, for determining whether it has achieved the preset value, if not then the ignition can't be conducted;

the step of determining the back pressure of the spray gun, for determining whether the atomized fuel oil gas pressure is within the preset range;

the step of determining flame ignition, for determining whether the igniter is ignited, if it is the case, then the fuel supplying means is regulated to output the fuel oil;

the step of determining ignition of the fuel oil, for determining whether the flame of fuel oil is ignited, if it is the case, then calculating required flow rate of air based on preset air/oil ratio and the outputting flow rate of the fuel oil, and regulating the air blowing means to blow air;

the step of determining the switch of the fuel oil, for determining whether the kind of fuel oil is changed, and calculating required flow rate of air based on corresponding preset air/oil ratio, and regulating the air blowing means to blow air.

The combustion control method for burner is wherein said combustion control method includes the following step of automatic operation:

the step of ignition and startup, in which the pressure signal of the atomized gas is obtained automatically, if the pressure value doesn't reach the preset value, the igniter is regulated not to spout combustible gas and ignited;

the step of the spouting of the atomized fuel oil gas, in which the back pressure value in the fuel oil atomizing means and the flame signal of the igniter are obtained automatically, the igniter is controlled to be started, thereby igniting the atomized fuel oil gas from the fuel oil atomizing means;

the step of adjusting automatically the outputting flow rate of the fuel oil, in which adjusting signal of the flame is obtained automatically, the fuel supplying means is regulated to output fuel oil to the fuel oil atomizing means based on the signal;

the step of controlling the switch of the fuel oil, for determining the case that the kind of fuel oil is varied, and calculating required flow rate of air based on preset corresponding air/oil ratio, and regulating the air blowing means to blow air.

the step of adjusting automatically the flow rate of air, in which required flow rate of air is calculated based on the outputting flow rate of the fuel oil as well as preset air/oil ratio, and the air blowing means is regulated to blow air.

The combustion control method for burner further includes the step of modifying the air/oil ratio, for re-setting the air/oil ratio and calculating required flow rate of air based on the new air/oil ratio, and regulating the air blowing means to blow air.

The combustion control method for burner further includes the step of determining the variation of the flame intensity, for determining the signal of variation of the flame intensity, correspondingly adjusting outputting flow rate of the fuel oil, and calculating required flow rate of air based on the air/oil ratio, and regulating the air blowing means to blow air.

The combustion control method for burner further includes the step of monitoring the operation state of the system, for determining atomized gas pressure, fuel pressure, flame condition, the state of fuel oil atomizing means, flame opening, air/oil ratio as well as temperature control signal, and showing them out.

The combustion control method for burner further includes the step of alarming, for receiving abnormal signal from the step of monitoring operation state of the system, and giving out sound/light alarm.

The combustion control method for burner is wherein said step of determining the switch of the fuel oil further includes the step of determining fuel oil atomized gas pressure and the step of determining fuel oil switching valve, for determining operation state of the fuel oil atomizing means, and determining the switch state of the fuel oil switching valve, thereby determining the variation of the kind of the fuel oil.

The combustion control method for burner is wherein said combustion control method may modify randomly air/oil ratios of the various fuel oils, and control automatically flow rate of fuel oil output by the fuel supplying means and flow rate of air blown by the air blowing means.

The combustion control method for burner is wherein in said combustion control method, the step of igniting is further controlled based on obtained flame signal and preset relevant parameters, in which it is automatically reignited after the flameout.

The combustion control method for burner is wherein in said combustion control method, the output of the atomized fuel oil gas is further controlled based on obtained flame signal and preset relevant parameters.

The combustion control method for burner is wherein in said combustion control method, automatic closed loop temperature control is achieved by obtaining temperature signal.

The combustion control method for burner is wherein in said combustion control method, various fuel oils can be automatically switched.

An autocontrol burner includes a main body, a fuel supplying means, an air blowing means, a fuel oil atomizing means and a igniter, wherein it further includes a controller, a motor speed controller and a signal acquisition assembly, in which the fuel supplying means and the air blowing means are connected with the controller via the motor speed controller, the signal output port of the signal acquisition assembly is connected with the signal input port of the controller, flow rate of fuel oil output by the fuel supplying means and flow rate of air blown by the air blowing means are adjusted automatically, simultaneously and proportionally by said controller based on preset air/oil ratio.

The autocontrol burner as above-described, wherein said fuel supplying means is a gear or screw type oil pump, and the air blowing means is a blower fan, and the fuel oil atomizing means is an internal-mixing type pneumatic atomizing spray gun, and the igniter is a gas ignition gun, and the signal acquisition assembly includes a flame monitor, an oil pressure transmitter and an atomized gas pressure switch etc, and the signal acquisition end of the flame monitor is located nearby the position of flame jet, and the oil pressure transmitter is located at the inlet of the oil way of the spray gun, the atomized gas pressure switch is locate at the inlet of the atomized gas, and said motor speed controller is an AC converter or DC motor governor, or AC motor electromagnetic governor.

The autocontrol burner as above-described, wherein said controller is a programmable controller, or an industrial control unit.

The autocontrol burner as above-described, wherein said controller includes a program control unit, which further includes:

an atomized gas pressure determining unit for determining whether the atomized gas pressure reaches preset value, if not, then it can't be ignited;

a spray gun back pressure determining unit for determining whether atomized fuel oil gas pressure is within the presetting range;

a flame ignition determining unit for determining whether the ignition gun is ignited, if it is the case, regulating the fuel pump and the fuel injecting valve to output fuel oil a fuel oil ignition determining unit for determining whether the flame of fuel oil is ignited, if it is the case, then calculating required flow rate of air based on preset air/oil ratio and outputting flow rate of the fuel oil, and regulating the blower fan to blow air;

a fuel oil switch determining unit for determining whether the kind of fuel oil is varied, and calculating required flow rate of air based on corresponding preset air/oil ratio, and regulating the blower fan to blow air.

The autocontrol burner as above-described, wherein the control unit of said controller further includes an air/oil ratio modifying and determining unit for re-setting the air/oil ratio randomly, and calculating required flow rate of air based on outputting flow rate of the fuel oil and new air/oil ratio, and regulating the rotation speed of said blower fan to adjust flow rate of air.

The autocontrol burner as above-described, wherein said program control unit further includes a flame intensity variation determining unit for determining the signal of variation of flame intensity, and correspondingly adjusting outputting flow rate of the fuel oil, and calculating required flow rate of air based on air/oil ratio, and regulating the blower fan to blow air.

The autocontrol burner as above-described, wherein said controller further includes a system operation state monitoring unit, for determining atomized gas pressure, fuel pressure, flame condition, state of the spray gun, flame opening, air/oil ratio as well as temperature control signal, and showing the operation state out by a information inputting/displaying means.

The autocontrol burner as above-described, wherein said controller is further connected with an alarm means, for receiving abnormal signal from system operation state monitoring unit, and giving out sound/light alarm.

The autocontrol burner as above-described, wherein said fuel oil switch unit further includes a fuel oil pressure determining unit and a fuel oil switching valve determining unit, for determining the operation state of the fuel oil atomizing means, and determining the switch state of the fuel oil switching valve, thereby determining whether the kind of fuel oil varies.

The autocontrol burner as above-described, wherein there is an electromagnetic valve as an ignition gas valve in the pipeline connecting the ignition gun, and there is an electromagnetic valve as an atomized gas valve in the pipeline connecting atomized gas pressure switch with the spray gun, and there is an electromagnetic valve as a fuel injecting valve in the pipeline connecting the oil pump with the input port of the spray gun, in which the signal input port of said ignition gas valve, said atomized gas valve and said fuel injecting valve is respectively connected with the signal output port of the controller, and the signal output port of said controller is further connected with an electromagnetic valve as an fuel oil switching valve, and the input port of the fuel oil switching valve is respectively connected with pipelines for various kinds of fuel, and the output port thereof is connected with the input port of the oil pump.

The autocontrol burner as above-described, wherein said controller is connected with an information inputting/displaying means.

The autocontrol burner as above-described, wherein signal input port of said controller is connected with a temperature controlling instrument.

The autocontrol burner as above-described, wherein said control unit further includes a temperature self-controlling unit for judging the signal from the temperature controlling instrument, thereby achieving closed loop temperature control of the autocontrol burner.

1—blower fan; 2—oil pump; 3—fuel oil regulating valve; 4—flow rate of air shutter; 5—electrical actuator; 6—control circuit of motor rotation direction; 7—fuel oil inlet; 8—atomized gas inlet; 9—spray gun; 10—ignition gun; 13—flame monitor; 15—flame nozzle; 16, 17—motor speed controller; 18—programmable controller; 19—ignition gas valve; 21—oil pressure transmitter; 22—blowing valve of spray gun; 23—atomized gas valve; 24—fuel injecting valve; 25—atomized gas pressure switch; 26—fuel oil switching valve; 27—light oil pipeline; 28—heavy oil pipeline; 30—temperature controlling instrument; 31—information inputting/displaying means; 32—program control unit; S1—the step of determining atomized gas pressure; S2—the step of determining back pressure of the spray gun; S3—the step of determining flame ignition; S4—the step of determining fuel oil ignition; S5—the step of determining fuel oil switch; S6—the step of modifying air/oil ratio; S7—the step of determining flame intensity variation.

THE PREFERRED EMBODIMENTS OF THE PRESENT INVENTION

Hereinafter the embodiments of autocontrol burner according to the present invention are described.

Figure 1:
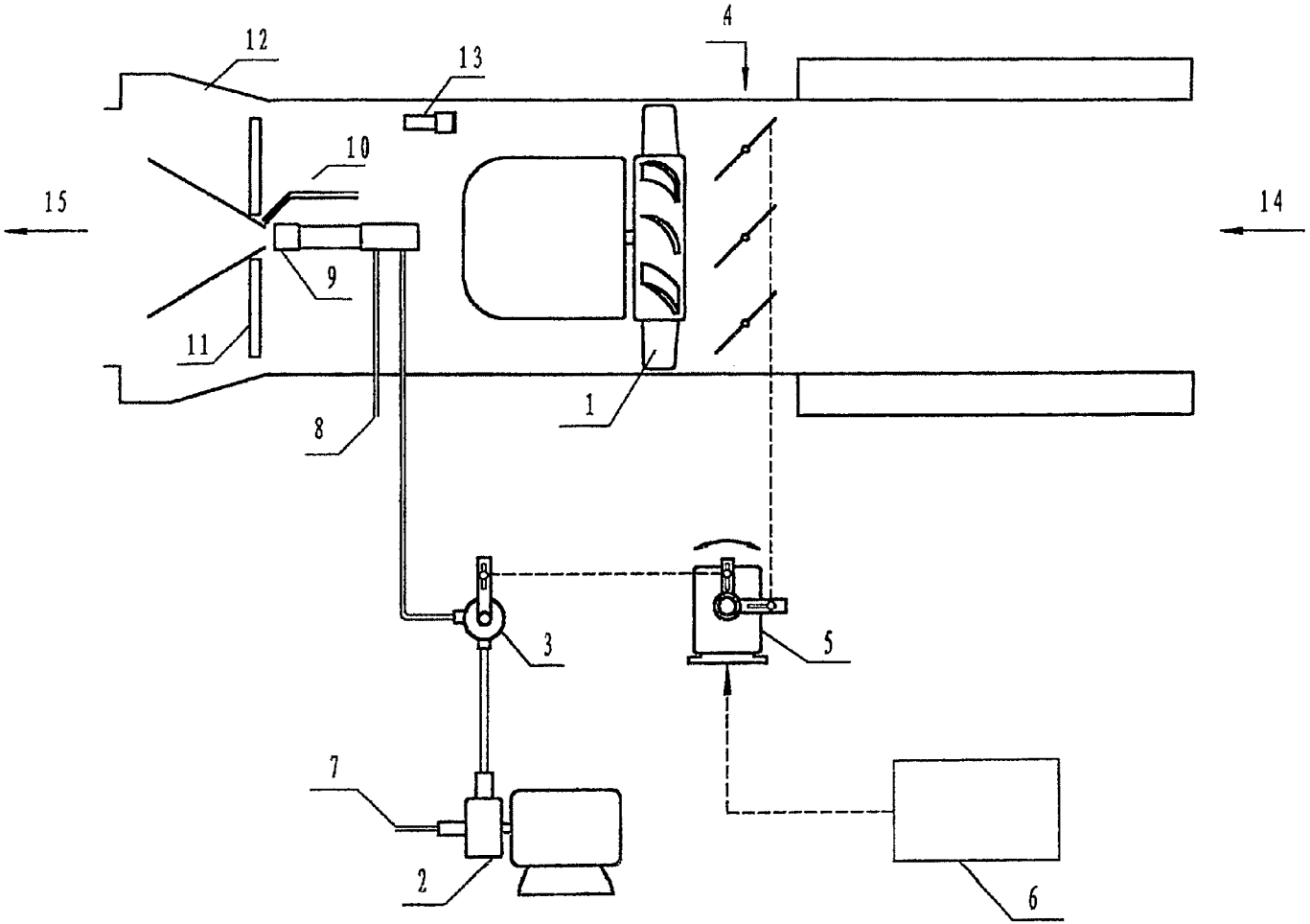
FIG. 1 is a constructional drawing of conventional auto burner.
Figure 2:
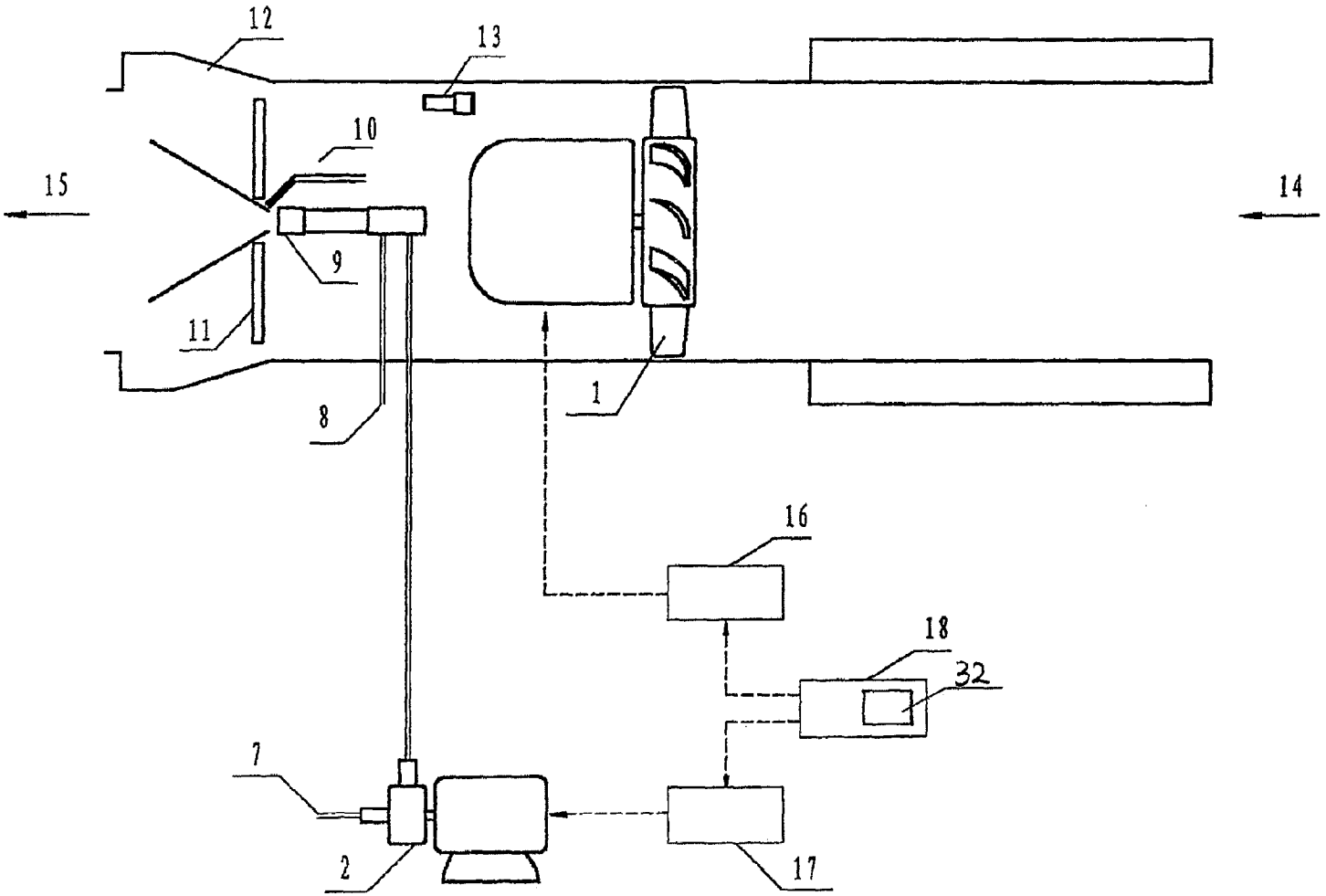
FIG. 2 is a schematic diagram of auto burner according to the present invention.
Figure 3:
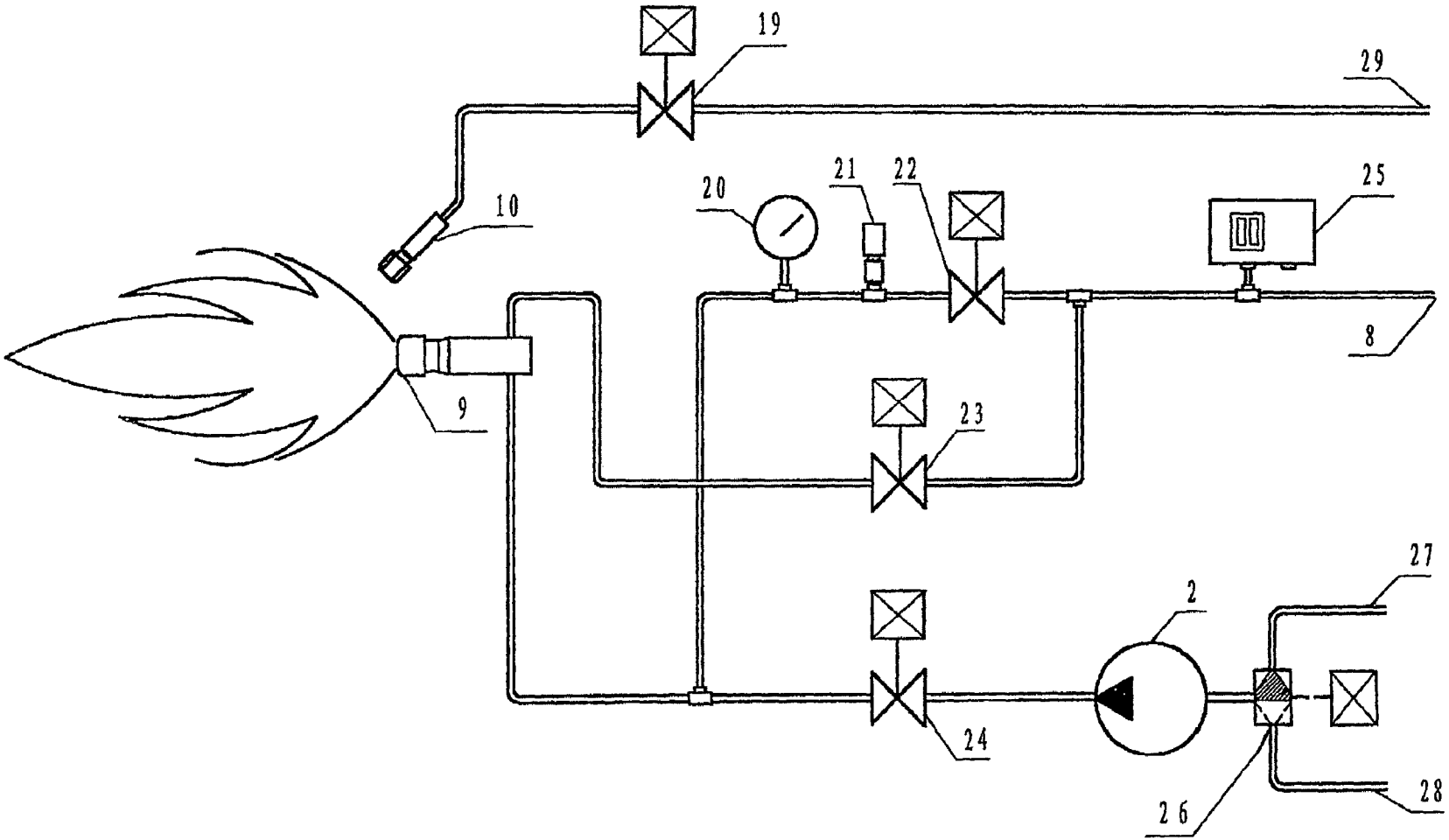
FIG. 3 is a schematic diagram showing the oil/gas way of the auto burner according to the present invention.
Figure 4:
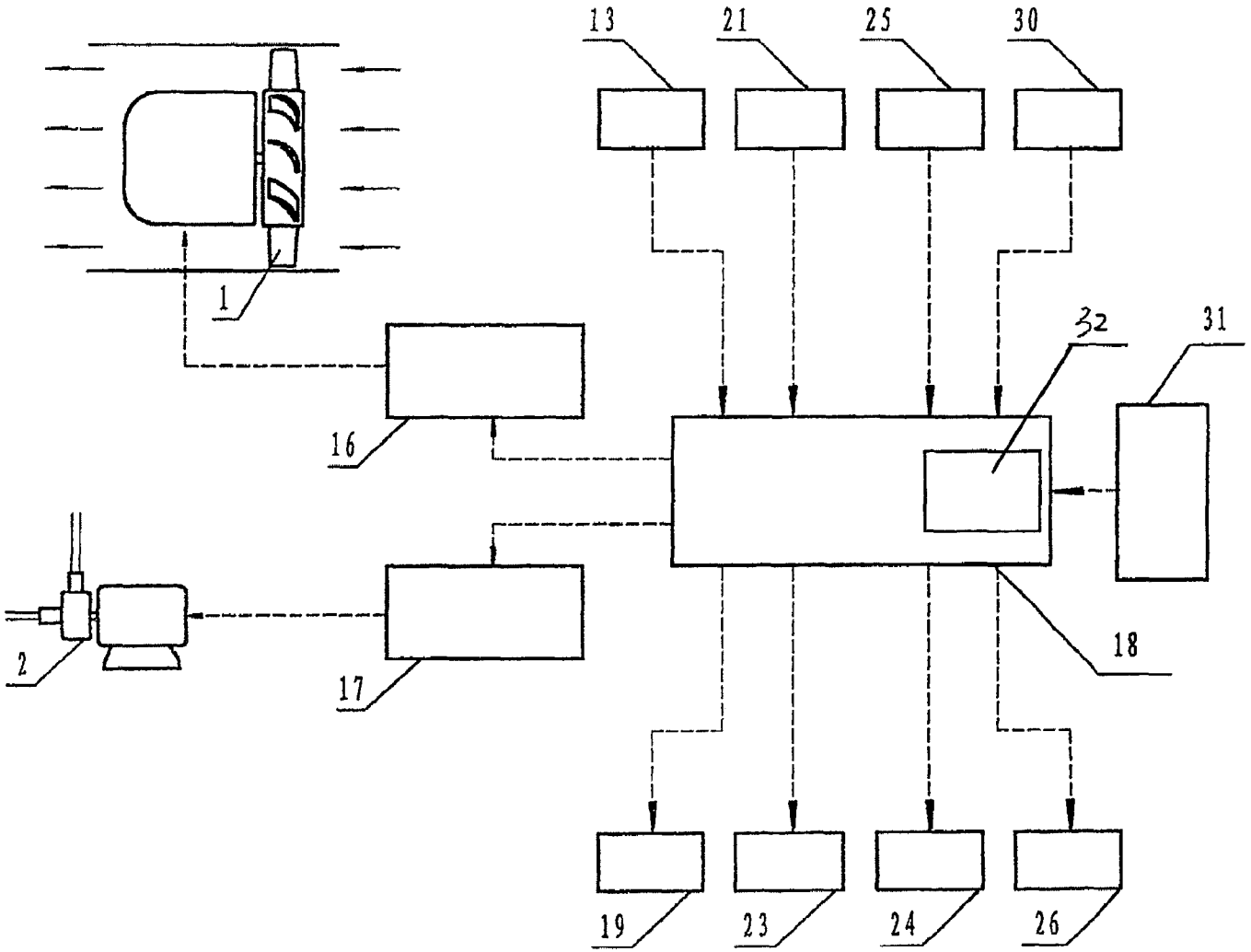
FIG. 4 is a schematic diagram showing the control system of the auto burner according to the present invention.

In FIGS. 2, 3 and 4, an autocontrol burner includes a main body, a gear or a screw type oil pump 2, a blower fan 1, an internal-mixing type pneumatic atomizing spray gun 9 and gas ignition gun 10, and further includes a programmable controller 18, motor speed controllers 16, 17 and signal acquisition assembly such as a flame monitor 13, an oil pressure transmitter 21, an atomized gas pressure switch 25 etc, in which the programmable controller 18 is of Siemens S7 type, the programmable controller 18 may be substituted by an industrial control unit, and the motor speed controllers 16, 17 are respectively of Siemens 430 and Siemens 420 type AC converter, or DC motor governor, or AC motor electromagnetism governor is employed. The oil pump 2 and the blower fan 1 are connected with the programmable controller 18 respectively via motor speed controller 16, 17, and the signal output port of signal acquisition assembly is connected with the signal input port of the programmable controller 18, and the programmable controller 18 can adjust automatically, simultaneously and proportionally fuel flow output by the oil pump 2 and flow rate of air blown by the blower fan 1 based on preset air/oil ratio.

The signal acquisition assembly is connected with the programmable controller 18, and the collected signals are transferred to the programmable controller 18 to be handled, in which the signal acquisition end of flame monitor 13 is located nearby the position of flame jet, and the oil pressure transmitter 21 is located at the inlet of the oil way of the spray gun 9, and the atomized gas pressure switch 25 is located at the atomized gas inlet 8.

The autocontrol burner of the present invention is further provided with several electromagnetic valves, in which one electromagnetic valve is provided as an ignition gas valve 19 in the pipeline 10 connecting the ignition gun, and another electromagnetic valve is provided as an atomized gas valve 23 in the pipeline connecting the atomized gas pressure switch 25 with the spray gun 9, and another electromagnetic valve is provided as an fuel injecting valve 24 in the pipeline connecting the oil pump 2 with the spray gun spray gun 9. The signal input ports of the ignition gases valve 19, the atomized gas valve 23 and the fuel injecting valve 24 are respectively connected with the signal output port of the programmable controller 18. The signal output port of the programmable controller 18 is also connected with an electromagnetic valve which functions as a fuel oil switching valve 26, input port of which is connected with a light oil pipeline 27 and a heavy oil pipeline 28 respectively, and output port of which is connected with the input port of the oil pump 2.

Figure 5:
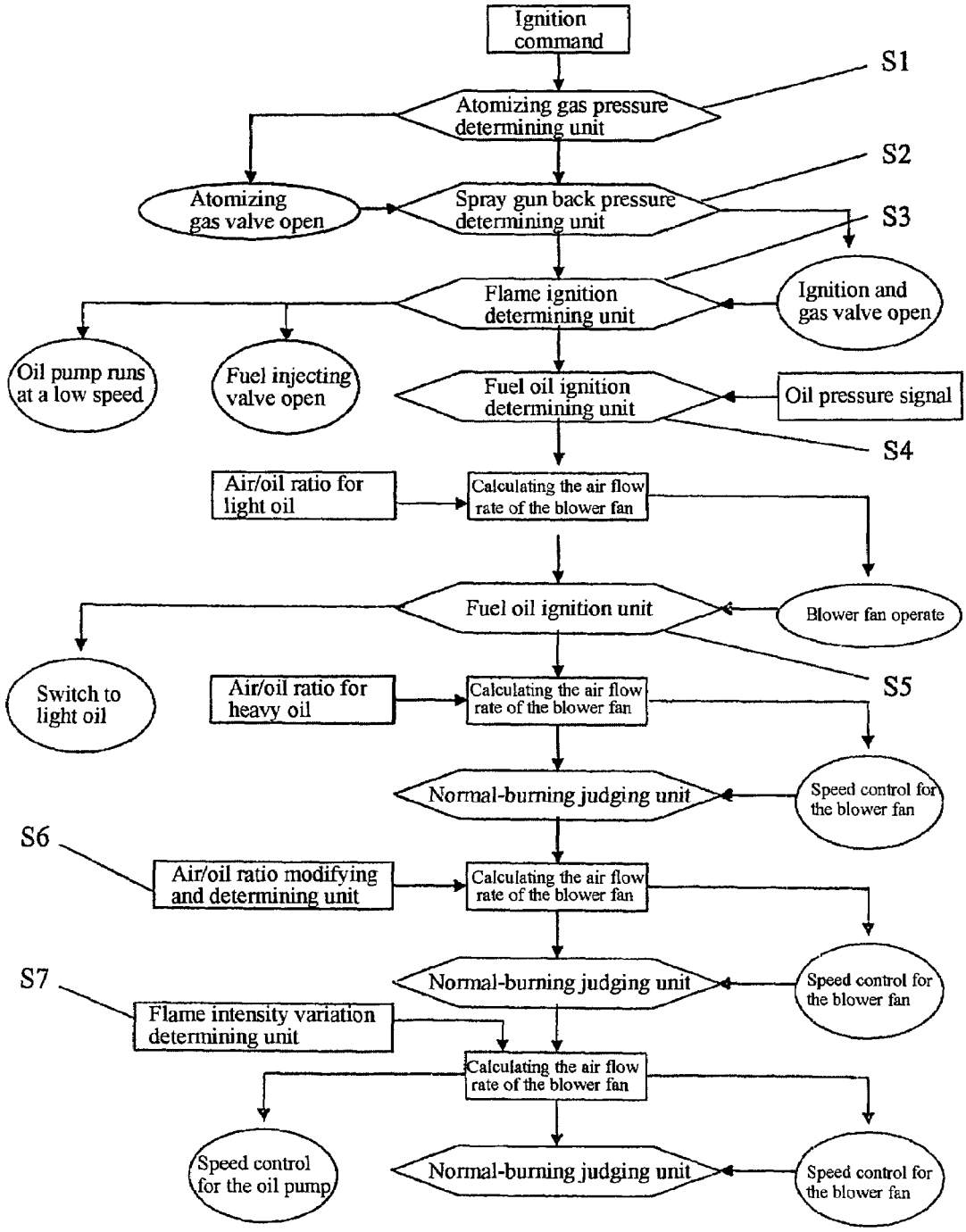
FIG. 5 is block diagram showing the auto-controlling flow of the present invention.

The programmable controller 18 includes a program control unit 32. In FIG. 5, said program control unit 32 further includes:

An atomized gas pressure determining unit, for determining whether it has achieved preset value, if not then it can't be ignited;

A spray gun back pressure determining unit, for determining whether the pressure of atomized fuel oil gas is within the preset range;

A flame ignition determining unit, for determining whether the ignition gun 10 is ignited, if it is the case, the oil pump 2 and fuel injecting valve 24 are regulated to output fuel oil for small flame;

A fuel oil ignition determining unit, for determining whether the flame of fuel oil is ignited, if it is the case, then calculating required flow rate of air based on preset air/oil ratio and the outputting flow rate of the fuel oil amount, and regulating the blower fan to blow air;

A fuel oil switch determining unit, for determining whether the type of fuel oil is changed, and calculating required flow rate of air based on preset corresponding air/oil ratio, and regulating the blower fan to blow air. The fuel oil switch unit further includes an atomized gas pressure determining unit and a fuel oil switching valve determining unit. The atomized gas pressure determining unit is used to determine the operation state of spray gun 9. The fuel oil switching valve determining unit is used to determine the switch state of fuel oil switching valve 26, thereby determining the change of fuel oil type.

An air/oil ratio modifying and determining unit, for resetting air/oil ratio, and calculating required flow rate of air based on outputting flow rate of the fuel oil amount and new air/oil ratio, and regulating rotating speed of the blower fan 1 for adjusting flow rate of air.

A flame intensity variation determining unit, for determining the signal of variation of flame intensity, adjusting the outputting flow rate of the fuel oil amount correspondingly, and calculating required flow rate of air based on air/oil ratio, and regulating the blower fan 1 to blow air.

The programmable controller 18 further includes a system operation state monitoring unit, for determining atomized gas pressure, fuel pressure, flame condition, state of spray gun, flame opening, air/oil ratio and temperature control signal, and showing the operation state by an information inputting/displaying means 31, for example displaying the text that "the atomized gas pressure is insufficiency, examine gas source please" etc.

The programmable controller 18 is further connected with an alarm means, for receiving abnormal signal from the system operation state monitoring unit, and giving out sound/light alarm.

The programmable controller 18 is further connected with an information inputting/displaying means 31, for modifying system parameter and displaying warning information of various malfunction alarms.

The signal input port of the programmable controller 18 is further connected with an temperature controlling instrument 30. The program control unit 32 of the programmable controller 18 further includes a temperature automatic controlling unit for determining signal from the temperature controlling instrument 30, thereby achieving the closed loop temperature control of the autocontrol burner.

All above-mentioned devices mainly constitute two system of the embodiment, namely combustion system and automatic control system, in which:

The combustion system is composed of a blower fan 1, an oil pump 2, a spray gun 9, an electric junction box, oil/gas way, automatic-controlling valves, an ignition gun 10, various signal acquisition assembly and a main body, and they are all attached to a base except for the oil pump thus compact structure is achieved.

With regard to the spray gun 9, advanced internal-mixing type pneumatic atomizing spray gun is employed in the embodiments, so that low pressure (<0.5 mpa) and poor-quality fuel oil such as residual oil etc can be atomized well and normal combustion can be carried out under the effect of the atomized gas. The fuel oil provided after frequency control is co-operated with suitable flow rate of air, so that the flame is in the optimal combustion condition, and regulating range of the flame intensity is broad, its size and shape is adjustable.

With regard to the blower fan 1, an axial flow fan is employed along with a frequency control system, without using mechanical type damper for adjusting flow rate of air in the embodiment.

With regard to the signal acquisition assembly, for the purpose of obtaining well regulated burning process, various transmitter and signal acquisition unit such as flame monitor 13 and flame, oil pressure, oil temperature and gas pressure transmitter are employed in the embodiment, for supplying the data of combustion process to the programmable controller 18 in which operation of various combustion data and autocontrol can be accomplished.

The automatic control system is composed of a programmable controller 18, an information inputting/displaying means 31(LCD), motor speed controllers 16, 17, optional instruments, various switch buttons and a console (cabinet) etc, and it has two operation state, i.e., automatic and manual operation states. The combustion system can be overall operated and monitored, thus achieving full automatic control function of the system.

Flame control of full frequency conversion is employed in the adjustment mode of the system, so that precise ratio regulation between fuel oil and flow rate of air is achieved. When changing of fuel oil leads to combustion deteriorative, precise regulation of air/oil ratio can be achieved by modifying air/oil ratio parameter. When fluctuation of fuel oil temperature leads to viscosity and flow rate to vary, the system can further provided fuel oil temperature control output, so as to further improve combustion quality and overall performance of the machine.

The programmable controller 18 and information inputting/displaying means 31 (LCD) are used in programmable control system of the system (PLC control system), which may display and input system parameter and facilitate the operator to know about means status and to modify system parameter; and carry out real time monitoring for status, thus automatic or manual control function of the whole combustion system based on instruction can be achieved; interlocking security protection of the whole system is also achieved.

Aforesaid autocontrol function further includes:

When started up: Self-checking of the induced air valve, startup of the air compressor and the draught fan (the above is of switching signal); frequency conversion driving of the oil pump 2 and the blower fan 1; automatic blowing, ignition, switch of fuel, simultaneous regulation of fuel oil and flow rate of air; constant temperature control of the fuel oil; clinker temperature control of closed loop PID, fuel oil temperature control of closed loop PID and temperature monitoring protection of exhaust gas (protective dedusting bag); when combined with optional precise temperature controlling instrument 30, closed loop (automatic presetting, self adapting) temperature control of system can be realized. When flameout occurs abruptly under the operation of auto state, the system will generate an alarm meanwhile reignition automatically to resume normal operations. If internal ignition failure exceeds specified time, the combustion system will stop operation automatically, and generate warning message of ignition failure.

When stopped: Switch of the fuel may be accomplished; the flame and the induced air valve may be turned down; full automatic function such as stopping the oil pump 2, the air compressor, the blower fan 1, draught fan in turn (time delay interval of each step may be predetermined) may be accomplished.

Manual functions of the control system may be realized respectively: the operation of air compressor, draught fan, blower fan 1, and oil pump 2; manual ignition, switch of fuel, simultaneous and proportional adjustment of fuel oil and flow rate of air; when combined with optional temperature controlling instrument 30, the function of automatic closed loop temperature control of the system may still be accomplished.

Protective function of the control system is monitoring real-time oil pressure, gas pressure, air pressure and flame, regardless of automatic or manual states, the system is always under perfect security protection. If mis-operation occurs at the time of startup, the system will refuse to act, only after blown and all safeguard requirements are satisfied it can be ignited. Once malfunction occurs in operation, the system will cut off fuel oil and air automatically, at the same time giving out corresponding sound/light alarm and prompt information, thus ensuring absolute safe of persons and device.

Display function of the control system is displaying whether operation of system is normal by sound-light signal. The information inputting/displaying means 31 (LCD) may display randomly twenty items of system parameter and failure messages, so as to help operator debug failure and resume running as soon as possible. The display further has the function of modifying parameter.

In addition, aforesaid control system may be further provided with fuel oil liquid level display etc.

In the embodiments of combustion control method for burner provided in the present invention, an autocontrol burner of the present invention is employed. This method includes the following steps: a given flow rate of fuel oil is supplied to the spray gun 9 from the oil pump 2; the spray gun 9 spouts the atomized fuel oil gas; the atomized fuel oil gas is ignited by the ignition gun 10; combustion is facilitated by the air blown by the blower fan 1; the outputting flow rate of fuel oil and flow rate of air are adjusted automatically simultaneously and proportionally by means of regulating rotating speed of electric motors of the oil pump 2 and the blower fan 1.

Figure 8:
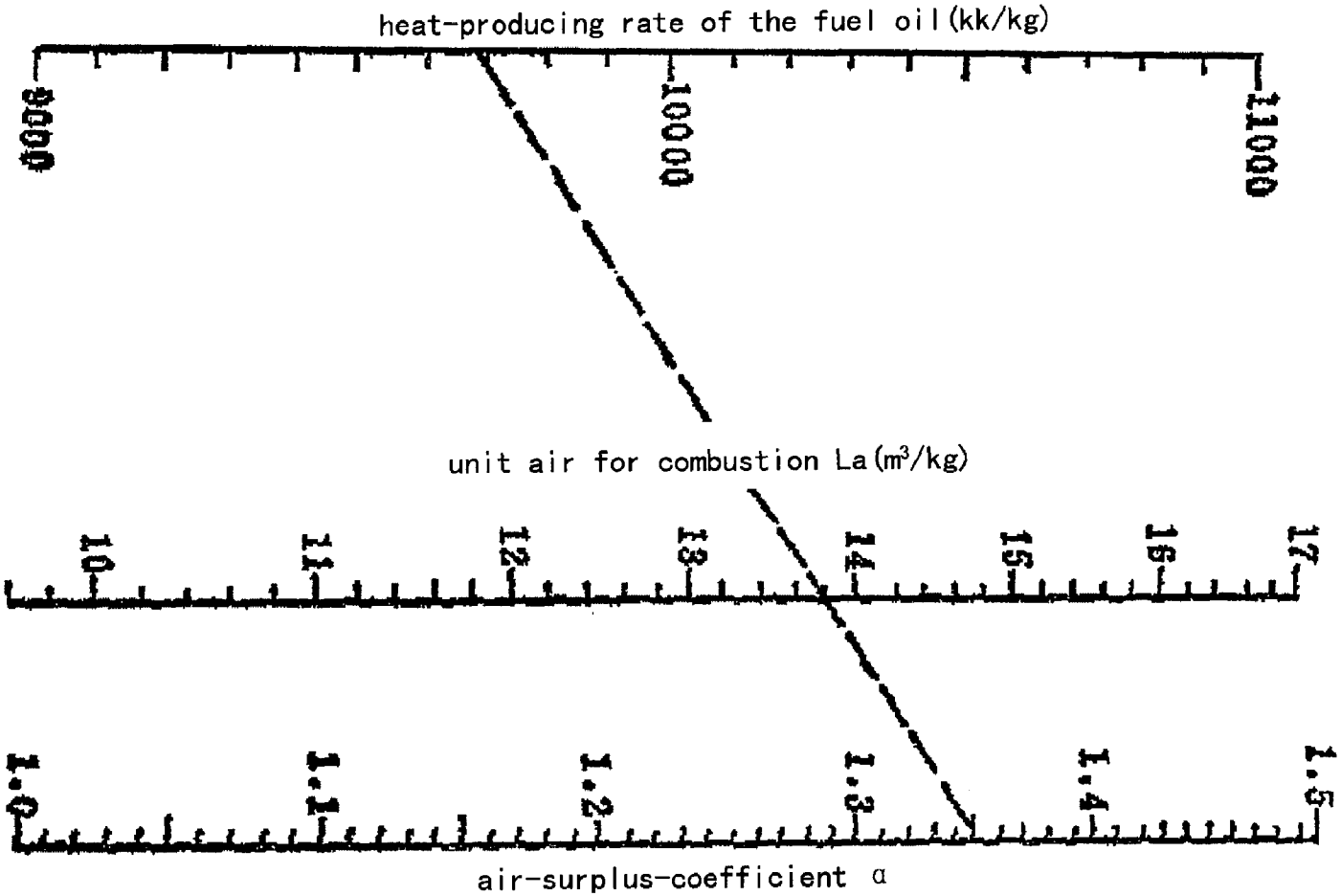
FIG. 8 is schematic diagram showing computation of the air/oil ratio according to the present invention.

Such proportional and simultaneous regulation control method is achieved by calculating flow rate of air and outputting flow rate of the fuel oil in accordance with preset air/oil ratio. In FIG. 8, the air/oil ratio is calculated based on specific relation curve, which is a relational curve between required flow rate of fuel oil output by the fuel supplying means and flow rate of air blown by the air blowing means in order to achieve optimal combustion effect.

Figure 6:
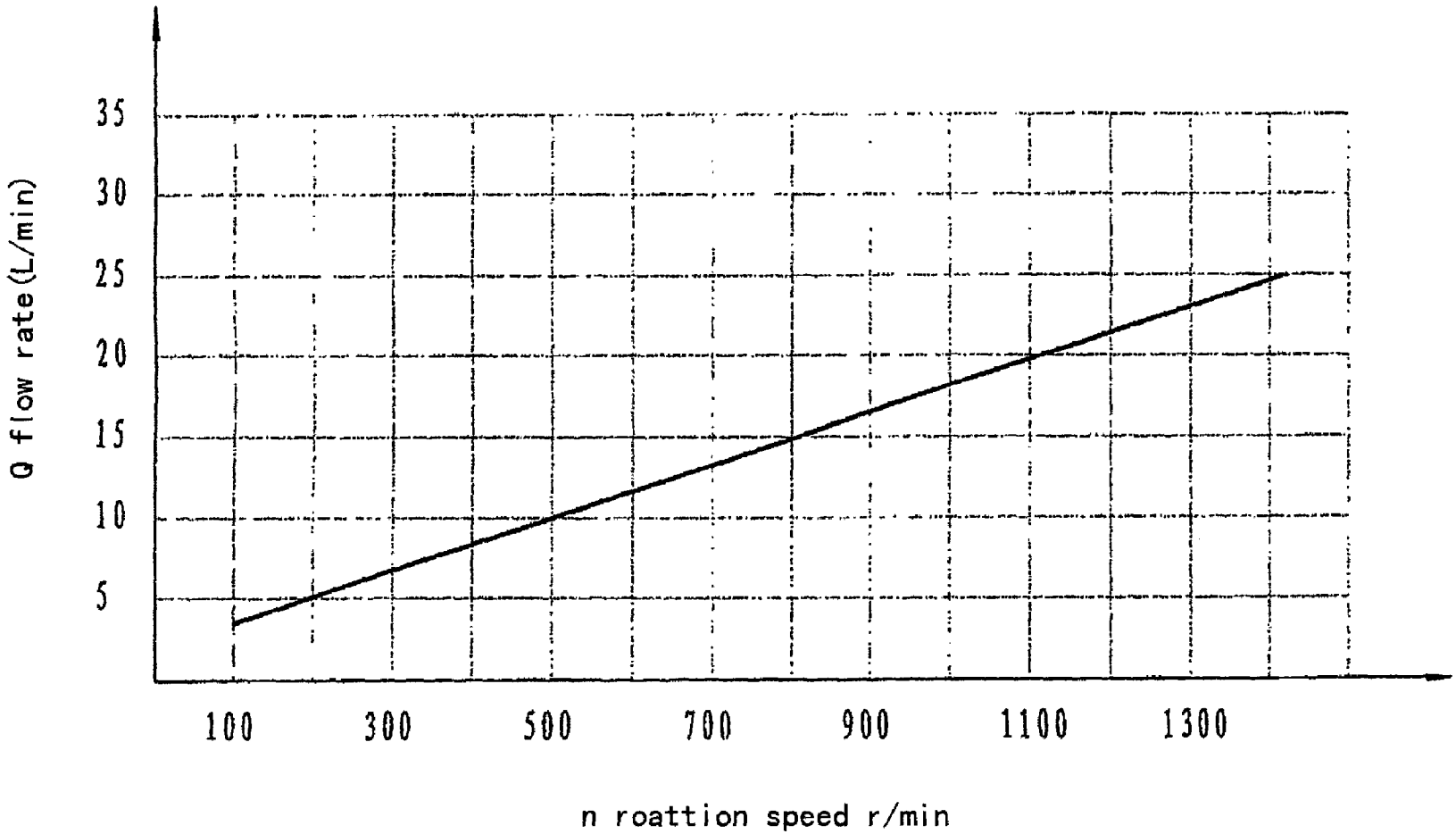
FIG. 6 is a view showing the relation curve between the rotation speed of the oil pump and the flow rate according to the present invention.
Figure 7:
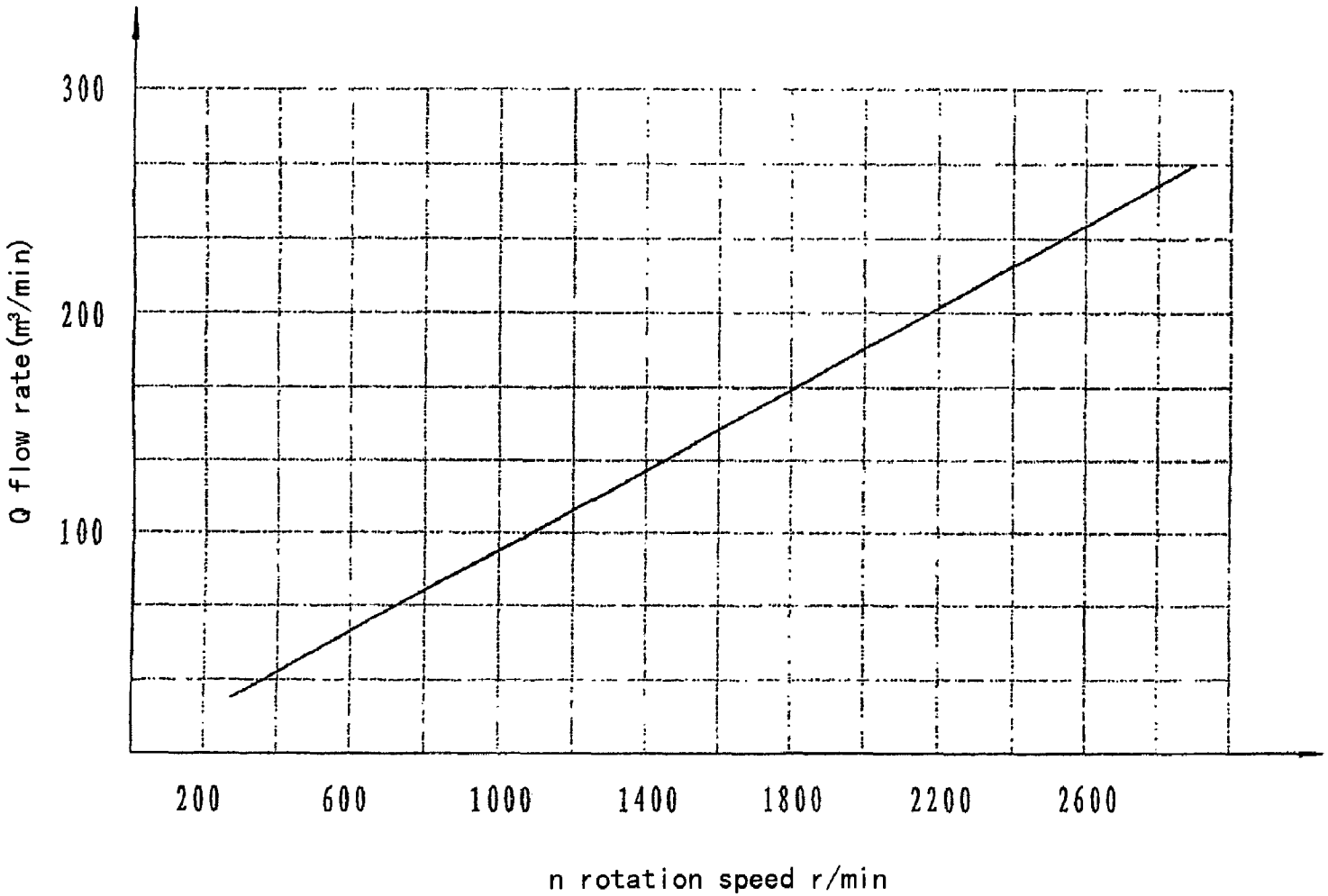
FIG. 7 is a view showing the relation curve between the rotation speed of the blower fan and the flow rate of air according to the present invention.

FIGS. 6 and 7 show a relation curve between rotating speed of the oil pump 2 and fuel flow and a relation curve between rotating speed of the blower fan 1 and flow rate of air respectively.

The autocontrol method is achieved in such a manner that an automatic control program adjusts the outputting flow rate of the fuel oil and the flow rate of air in accordance with air/oil ratio. As shown in FIG. 5, the automatic control program including the following steps;

The step S1 of determining atomized gas pressure, for determining whether atomized gas pressure (compressed air, water vapor) reaches preset value, and the pressure signal is transferred to the programmable controller 18 via atomized gas pressure switch 25, if not the ignition cannot be conducted; When the atomized gas pressure reaches the preset value, the programmable controller 18 may regulate atomized gas valve 23 to be open, so that atomized fuel oil gas is spouted from spray gun 9;

The step S2 of determining back pressure of the spray gun, for determining whether atomized fuel oil gas pressure is within a preset range, the oil pressure transmitter 21 may detect pressure signal of the atomized fuel oil gas and transfer it to the programmable controller 18, if the pressure value is within the preset range, the ignition gas valve 19 is regulated to ignite, otherwise the ignition can not be conducted;

The step S3 of determining flame ignition, for determining whether the ignition gun 10 is ignited, if it is the case, then the flame signal is transferred to the programmable controller 18 via flame monitor 13 so as to regulate fuel injecting valve 24 to be open, so that the oil pump 2 is regulated to output the fuel oil for small flame;

The step S4 of determining ignition of the fuel oil, for determining whether flame of fuel oil is ignited, if it is the case, then required flow rate of air is calculated based on outputting flow rate of the fuel oil by the oil pump 2 and preset air/oil ratio, and the blower fan 1 is regulated by motor speed controller 16 to blow air according to given rotating speed;

The step S5 of determining the switch of the fuel oil, for determining whether the kind of fuel oil is changed, and the programmable controller 18 regulates fuel oil switching valve 26 to act, so that inlet of the oil pump 2 is communicated with heavy oil pipeline 28, and determining the change of the kind of the fuel oil by change of the oil pressure value provided by the oil pressure transmitter 21, and calculating required flow rate of air based on spouted oil amount and corresponding preset air/oil ratio, and regulating the blower fan 1 to blow air, thereby achieving automatic switch of fuel oil.

The step S6 of modifying the air/oil ratio, for re-presetting the air/oil ratio, and after transferring the new air/oil ratio to the programmable controller 18, required flow rate of air is calculated based on the new air/oil ratio, and the blower fan 1 is regulated to blow air.

The step S7 of determining the variation of the flame intensity, for determining the signal of variation of the flame intensity, and transferring the signal of variation of the flame intensity to the programmable controller 18 by the flame monitor 13, so that outputting flow rate of the fuel oil is adjusted correspondingly with the programmable controller, and required flow rate of air is calculated based on the air/oil ratio, and the blower fan 1 is regulated to blow air.

The combustion control method for such burner further includes the step of monitoring the operation state of the system, for determining atomized gas pressure, fuel pressure, flame condition, the state of fuel oil atomizing means, flame opening, air/oil ratio as well as temperature control signal, and showing them out.

The Combustion control method for such burner further includes the step of alarming, for receiving abnormal signal from the step of monitoring operation state of the system, and giving out sound/light alarm.

The step S5 of determining the switch of the fuel oil further includes the step of determining fuel pressure and the step of determining fuel oil switching valve, for determining operation state of the spray gun 9 and determining the switch state of the fuel oil switching valve 26, thereby determining the variation of the kind of the fuel oil.

The combustion control method for such burner can further control the step of the ignition and output of atomized fuel oil gas etc in accordance with obtained flame signal and preset relevant parameters.

The combustion control method for such burner can also achieve automatic closed loop temperature control of the system by obtaining temperature signal.

INDUSTRIAL APPLICABILITY

Oil amount and blown flow rate of air can be regulated precisely during fuel oil switch and the regulation of flame intensity in the present invention, so that the flame is always in optimal combustion condition. Compared with the conventional combustion system the present invention has the following advantages: advanced technology, reasonable structure, long lifetime, high cost performance, low energy consumption, low attrition, low noise, low pollution. Taking economy as an example, when compared with conventional pressure atomization type burner, fuel oil can be saved more than 10% theoretically, for example, 1 ton/hour of burner can save more than 500,000 Yuan by 180 day/year. Moreover, if light oil is substituted by heavy oil, there will be saving more than 1,000,000 Yuan every year.

The invention claimed is:

1. An autocontrol burner includes a main body, a fuel supplying means, an air blowing means, a fuel oil atomizing means and a igniter, wherein it further includes a controller, a motor speed controller and a signal acquisition assembly, in which the fuel supplying means and the air blowing means are connected with the controller via the motor speed controller, the signal output port of the signal acquisition assembly is connected with the signal input port of the controller, flow rate of fuel oil output by the fuel supplying means and flow rate of air blown by the air blowing means are adjusted automatically, simultaneously and proportionally by said controller based on preset air/oil ratio, wherein said controller includes a program control unit, said program control unit includes an air/oil ratio modifying and determining unit for re-setting the air/oil ratio randomly, and calculating required flow rate of air based on outputting flow rate of the fuel oil and new air/oil ratio, and regulating the rotation speed of said blower fan to adjust flow rate of air, wherein said fuel supplying means is a gear or screw type oil pump, and the air blowing means is a blower fan, and the fuel oil atomizing means is an internal-mixing type pneumatic atomizing spray gun, and the igniter is a gas ignition gun, and the signal acquisition assembly includes a flame monitor, an oil pressure transmitter and an atomized gas pressure switch, and the signal acquisition end of the flame monitor is located nearby the position of flame jet, and the oil pressure transmitter is located at the inlet of the oil way of the spray gun, the atomized gas pressure switch is located at the inlet of the atomized gas, and said motor speed controller is an AC converter or DC motor governor, or AC motor electromagnetic governor.

2. The autocontrol burner according to claim 1, wherein said controller is a programmable controller, or an industrial control unit.

3. The autocontrol burner according to claim 1, wherein said program control unit further includes;

an atomized gas pressure determining unit for determining whether the atomized gas pressure reaches preset value, if not, then it can't be ignited;

a spray gun back pressure determining unit for determining whether atomized fuel oil gas pressure is within the presetting range;

a flame ignition determining unit for determining whether the ignition gun is ignited, if it is the case, regulating the fuel pump and the fuel injecting valve to output fuel oil;

a fuel oil ignition determining unit for determining whether the flame of fuel oil is ignited, if it is the case, then calculating required flow rate of air based on preset air/oil ratio and outputting flow rate of the fuel oil, and regulating the blower fan to blow air;

a fuel oil switch determining unit for determining whether the kind of fuel oil is varied, and calculating required flow rate of air based on corresponding preset air/oil ratio, and regulating the blower fan to blow air.

4. The autocontrol burner according to claim 3, wherein said fuel oil switch unit further includes a fuel oil pressure determining unit and a fuel oil switching valve determining unit, for determining the operation state of the fuel oil atomizing means, and determining the switch state of the fuel oil switching valve, thereby determining whether the kind of fuel oil varies.

5. The autocontrol burner according to claim 1, wherein said program control unit further includes a flame intensity variation determining unit for determining the signal of variation of flame intensity, and correspondingly adjusting outputting flow rate of the fuel oil, and calculating required flow rate of air based on air/oil ratio, and regulating the blower fan to blow air.

6. The autocontrol burner according to claim 1, wherein said controller further includes a system operation state monitoring unit, for determining atomized gas pressure, fuel pressure, flame condition, state of the spray gun, flame opening, air/oil ratio as well as temperature control signal, and showing the operation state out by an information inputting/displaying means.

7. The autocontrol burner according to claim 6, wherein said controller is further connected with an alarm means, for receiving abnormal signal from system operation state monitoring unit, and giving out sound/light alarm.

8. The autocontrol burner according to claim 1, wherein there is an electromagnetic valve as an ignition gas valve in the pipeline connecting the ignition gun, and there is an electromagnetic valve as an atomized gas valve in the pipeline connecting atomized gas pressure switch with the spray gun, and there is an electromagnetic valve as a fuel injecting valve in the pipeline connecting the oil pump with the input port of the spray gun, in which the signal input port of said ignition gas valve, said atomized gas valve and said fuel injecting valve is respectively connected with the signal output port of the controller, and the signal output port of said controller is further connected with an electromagnetic valve as an fuel oil switching valve, and the input port of the fuel oil switching valve is respectively connected with pipelines for various kinds of fuel, and the output port thereof is connected with the input port of the oil pump.

9. The autocontrol burner according to claim 8, wherein said controller is connected with an information inputting/displaying means.

10. The autocontrol burner according to claim 9, wherein signal input port of said controller is connected with a temperature controlling instrument.

11. The autocontrol burner according to claim 10, wherein said control unit further includes a temperature self-controlling unit for judging the signal from the temperature controlling instrument, thereby achieving closed loop temperature control of the autocontrol burner.

* * * * *